US010856080B2

(12) United States Patent
Zheng et al.

(10) Patent No.: US 10,856,080 B2
(45) **Date of Patent: *Dec. 1, 2020**

(54) AUDIO SIGNAL ECHO REDUCTION

(71) Applicant: Guoguang Electric Company Limited, Guangzhou (CN)

(72) Inventors: Jimeng Zheng, Shenzhen (CN); Yuli You, Laguna Beach, CA (US)

(73) Assignee: Guoguang Electric Company Limited, Guangzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/161,216

(22) Filed: Oct. 16, 2018

(65) Prior Publication Data

US 2019/0082259 A1 Mar. 14, 2019

Related U.S. Application Data

(63) Continuation of application No. 15/704,235, filed on Sep. 14, 2017, now Pat. No. 10,154,343.

(51) Int. Cl.
*H04R 3/04* (2006.01)
*H04R 3/00* (2006.01)

(52) U.S. Cl.
CPC ..... *H04R 3/04* (2013.01); *H04R 3/002* (2013.01)

(58) Field of Classification Search
CPC ..... H04R 1/1083; H04R 3/002; H04R 3/04; H04R 2460/01; G10K 2210/505; G10K 2210/3023; G10K 2210/30232
USPC ..... 381/71.1, 71.2, 71.11, 71.12, 71.14
See application file for complete search history.

(56) References Cited

U.S. PATENT DOCUMENTS 7,386,135 B2 * 6/2008 Fan ..... H04R 3/005 381/111
7,773,759 B2 * 8/2010 Alves ..... G10L 21/02 379/406.01
2005/0074129 A1 * 4/2005 Fan ..... H04R 3/005 381/56

(Continued)

OTHER PUBLICATIONS

Tanrikulu, Oguz, et al., "Residual Echo Signal in Critically Sampled Subband Acoustic Echo Cancelers Based on IIR and FIR Filter Banks", Transactions on Signal Processing, IEEE, vol. 45 pp. 901-912, 10.1109/78.564178.

(Continued)

*Primary Examiner* — William A Jerez Lora
(74) *Attorney, Agent, or Firm* — Joseph G Swan, PC

(57) ABSTRACT

Provided are, among other things, systems, methods and techniques for reducing echo in an audio signal. One representative embodiment involves obtaining an input signal, an estimate of a system-characterizing function, and a reference signal, each at a corresponding sample rate and each divided into a plurality of sub-bands; separately processing such sub-bands, where for a given sub-band the estimate of the system-characterizing function and the reference signal are processed to generate an echo-estimation signal and then the echo-estimation signal is subtracted from the input signal to provide an echo-corrected signal for such given sub-band; and combining the echo-corrected signal from each of different ones of the plurality of the sub-bands to provide a final output signal, with the echo-estimation signal generated using a processing sample rate that is lower than the sample rate for the input signal.

20 Claims, 7 Drawing Sheets

(56) References Cited

U.S. PATENT DOCUMENTS

| | | | | |
|---|---|---|---|---|
| 2008/0037801 | A1* | 2/2008 | Alves | G10L 21/02 381/71.6 |
| 2008/0144848 | A1* | 6/2008 | Buck | H04M 9/082 381/66 |
| 2009/0271187 | A1* | 10/2009 | Yen | G10L 21/0208 704/226 |
| 2012/0163615 | A1* | 6/2012 | Li | H04M 9/082 381/71.1 |

OTHER PUBLICATIONS

Chen, Zhixin, "Design and Implementation on a Sub-band based Acoustic Echo Cancellation Approach", International Journal of Advanced Computer Science and Applications, vol. 2, No. 6, pp. 43-48 (2011).

Storn, Rainer, "Echo Cancellation Techniques for Multimedia Applications—a Survey", International Computer Science Institute, TR-96-046, (Nov. 1996).

De León, P.L., et al. (1996) "Acoustic Echo Cancellation Using Subband Adaptive Filtering", chapter 11 (pp. 348-368) in Akansu, A.N., et al., "Subband and Wavelet Transforms", The Kluwer International Series in Engineering and Computer Science, vol. 340. Springer, Boston, MA.

Petraglia, M.R., et al., "Adaptive FIR Filter Structure Based on the Generalized Subband Decomposition of FIR Filters", IEEE Transactions on Circuits and Systems II: Analog and Digital Signal Processing, vol. 40, No. 6, pp. 354-362 (Jun. 1993 ).

Gilloire, A., "Adaptive Filtering in Subbands with Critical Sampling: Analysis, Experiments, and Application to Acoustic Echo Cancellation", IEEE Tran. on Signal Processing, vol. 40, No. 8, pp. 1862-1875 (Aug. 1992).

Vaidyanathan, P. P., "Multirate Systems and Filter Banks", Prentice Hall, 1993, ISBN 0136057187, 9780136057185.

Prosecution history of, including prior art cited in, parent U.S. Appl. No. 15/704,235, filed Sep. 14, 2017.

* cited by examiner

AUDIO SIGNAL ECHO REDUCTION

FIELD OF THE INVENTION

The present invention pertains, among other things, to systems, methods and techniques for audio signal processing and has particular applicability to reduction of echoes in an audio signal.

BACKGROUND

The existence of echo is a frequent problem in audio systems. One example of an audio subsystem 10 in which echo arises is shown in FIG. 1. Subsystem 10 might be included, e.g., at one end of a duplex audio (e.g., communication) system. In it, audio signals are both input and output simultaneously. Specifically, a received signal 12, designated as $R_x$ in FIG. 1 (which typically will have been subject to some prior processing, not shown in FIG. 1), is output through a speaker 14. Simultaneously, a microphone 16 inputs a signal 18, a digitized version of which being designated as x(n), also referred to as digital input signal 19, which ultimately is, e.g., transmitted to a recipient, recorded, or used in some other manner.

Unfortunately, it frequently is the case that some portion of the audio signal 12 that is played through speaker 14 reaches microphone 16, typically with some modifications, which are represented in FIG. 1 by discrete-time finite impulse response f(n). Contributions to impulse response f(n) might come, e.g., from characteristics of the speaker 14, sound-reflective and/or sound-absorptive surfaces within the same space as speaker 14 and microphone 16, and/or characteristics of the air between speaker 14 and microphone 16.

In order to address this issue, the signal x(n) 19 conventionally is processed by a digital echo canceler 20, which attempts to remove the echo noise. For this purpose, in the current disclosure: r(n) is used to denote the echo reference signal 22 (which typically is a digitized version of the received signal 12 that is provided to the speaker 14), x(n) 18 (as noted above) is a digitized version of the signal received by microphone 16, and y(n) is the echo cancellation (EC) digital output signal 24. Conventionally, all three of such signals are at the same sampling rate R, and the relationship between x(n) and r(n) is:

$$x(n)=r(n)*f(n)+d(n)$$

where * denotes the convolution operation and d(n) is a digitized version of the near-end target signal (i.e., a digitized version of the microphone input signal 18 that would be present in the absence of echo noise). Ideally, echo canceler 20 outputs y(n)=d(n). For this purpose, an estimate of the impulse response f(n), i.e., f(n), n=0, . . . , L−1 (where L is the chosen echo reference length), typically is generated. In conventional EC algorithms, Least-Mean-Square (LMS) or Normalized-Least-Mean-Square (NLMS) algorithms are used to continuously update the impulse response estimate, $\hat{f}(n)$, at each of the time samples at the original sampling rate R. Then, in certain conventional subsystems 10, the echo canceler 20 is implemented such that:

$$y(n)=x(n)-r(n)*\hat{f}(n)=x(n)-\Sigma_{\tau=0}^{L-1}\hat{f}(\tau)r(n-\tau) \quad \text{Eq. 1}$$

Such systems can be considered to employ a full-band EC algorithm.

Alternatively, as shown in FIG. 2, a conventional sub-band EC system 20 decomposes 30 the full-band input signals into M equally divided sub-bands. Such sub-band input signals can be denoted as $x_m(n)$ and $r_m(n)$ for m=1, . . . , M. Conventionally, these band-passed sub-band signals have the same sampling rate R as the original input signals. Those sub-band signals are then down-sampled 32 by a factor of D, mainly for the purpose of reducing the data rate and thereby reducing computational complexity.

The down-sampled signals, which can be denoted as $x_m^D(n)$ and $r_m^D(m)$ for m=1, . . . , M, respectively, now at the sampling rate $$\frac{R}{D'}$$

are then fed into the corresponding sub-band's echo cancellation module $\mathbf{34}_m$, labeled EC-m in FIG. 2 and sometimes referred to as such in this disclosure. Each such echo cancellation module $\mathbf{34}_m$ also processes at the sampling rate R/D and, hence, uses much less computational resources than if it were running at the original sampling rate R. Otherwise, the echo cancellation modules $\mathbf{34}_m$ also implement Equation 1 above. The output, $y_m^D$, of each echo cancellation module $\mathbf{34}_m$ is then up-sampled 36 by a factor of D. Finally, all such up-sampled sub-band output signals $y_m$ are resynthesized 40 into a full-band output signal 42 (i.e., y(n)).

In certain conventional sub-band implementations, to further save on computational resources, the down-sampling operations 32 are combined into the decomposition module 30, and the up-sampling operations 36 are combined into the resynthesis module 40. However, for either such implementation, it has been widely reported that increased down-sampling, while resulting in less computational complexity, also diminishes echo-reduction performance.

Conventional sub-band echo cancellation systems typically have faster convergence and better steady-state echo suppression performance than full-band systems. However, such improvements over traditional full-band echo cancellation are provided at the cost of a significant increase in computational (or system) complexity.

SUMMARY OF THE INVENTION

Among other benefits, the present invention provides systems, methods and techniques that can reduce such complexity. According to certain approaches of the present invention, sub-band decomposition of x(n) is performed at a different rate than sub-band decomposition of r(n), e.g., by using different downsampling rates. In certain approaches, x(n) is processed at one sampling rate and r(n) is processed at one or more different (preferably lower) rate(s). In either event, by properly constructing each subband's echo canceller, such different rates can be used to effectively reduce the echo reference length L and hence can help to: (1) reduce the echo canceler's computational complexity, (2) speed-up the echo canceler's convergence stage, and (3) stabilize the echo canceler's adaptive-learning and echo-reduction performance.

One particular embodiment of the invention is directed to a method of reducing echo in an audio signal. According to this method, an input signal, an estimate of a system-characterizing function, and a reference signal, each at a corresponding sample rate and each divided into a plurality of sub-bands are obtained. Such sub-bands are separately processed, such that for a given sub-band the estimate of the system-characterizing function and the reference signal are processed to generate an echo-estimation signal and then such echo-estimation signal is subtracted from the input signal to provide an echo-corrected signal for that given sub-band. The echo-corrected signals from different ones of the sub-bands are then combined to provide a final output signal. One feature of this method is that the echo-estimation signal is generated using a processing sample rate that is lower than the sample rate for the input signal.

Another embodiment is directed to a system for reducing echo in an audio signal, which includes: (a) a number of echo-cancellation modules, each such echo-cancellation module including: (i) an echo-estimation module that inputs an estimate of a system-characterizing function at a first sample rate and a reference signal at a second sample rate and that, processing at a third sample rate, outputs an echo estimate signal at a fourth sample rate, and (ii) a subtractor that subtracts the echo estimate signal from an input signal, also at the fourth sample rate, to produce an echo-canceled sub-band signal at the fourth sample rate; and (b) a synthesis module that synthesizes the echo-canceled sub-band signals from the echo-cancellation modules to produce a final output signal. In the system, the third sample rate is lower than the fourth sample rate.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the accompanying drawings. However, it should be understood that the drawings merely depict certain representative and/or exemplary embodiments and features of the present invention and are not intended to limit the scope of the invention in any manner. The following is a brief description of each of the accompanying drawings.

DESCRIPTION OF THE PREFERRED EMBODIMENT(S)

The following discussion concerns, among other things, improved systems, methods and techniques for performing audio signal echo cancellation. As used herein, the term "cancellation" does not necessarily refer to complete cancellation. Although complete cancellation often is the preferred goal, some amount of echo ultimately might remain. Instead, expressions referring to echo cancellation herein are better understood as reducing echo to some tolerable level, often subject to other trade-offs.

Exemplary Embodiment

Figure 1:
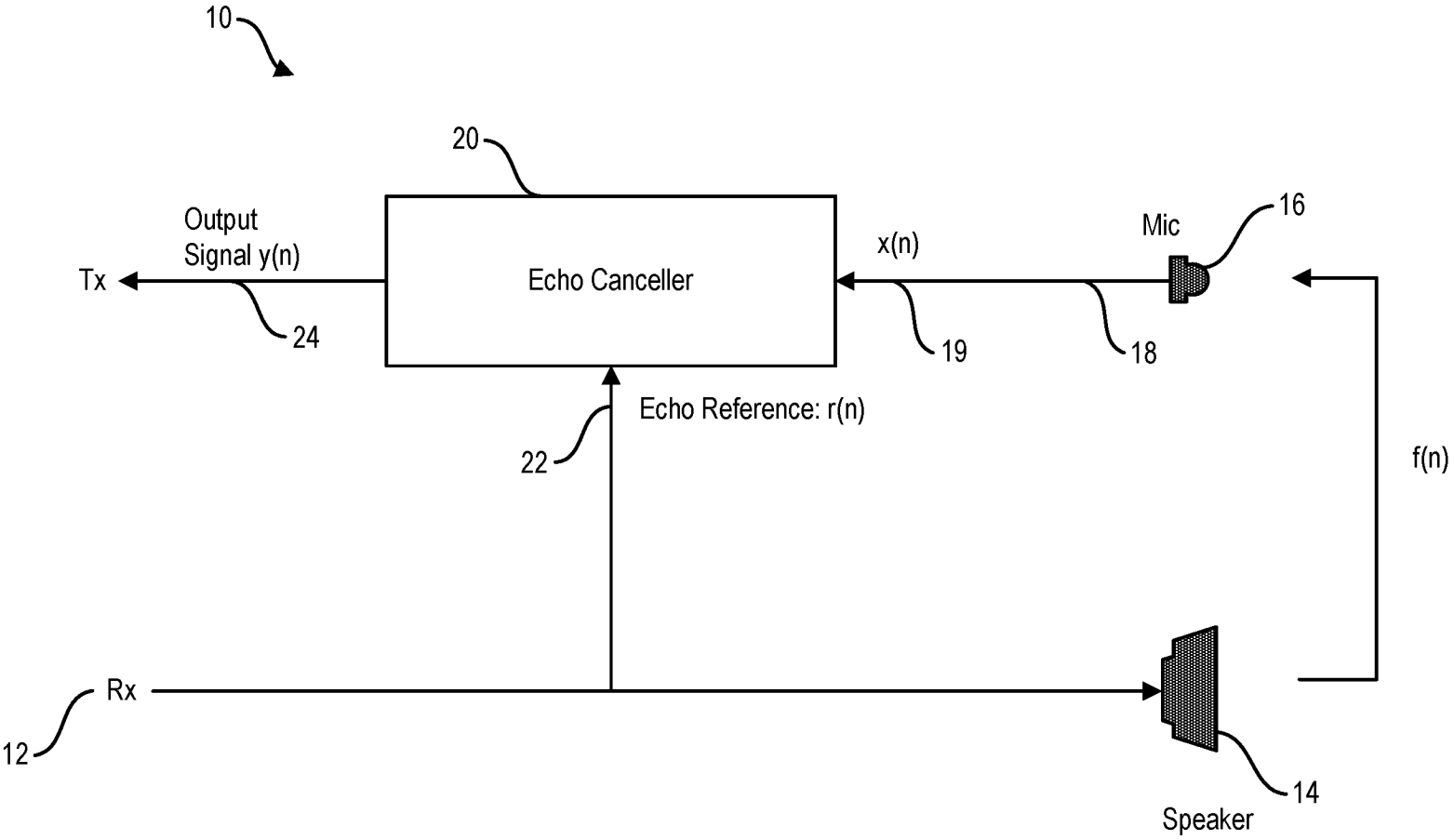
(PRIOR ART) FIG. 1
FIG. 1 is a block diagram of an audio subsystem, illustrating how echo can arise and including a module for canceling such echo.
Figure 2:
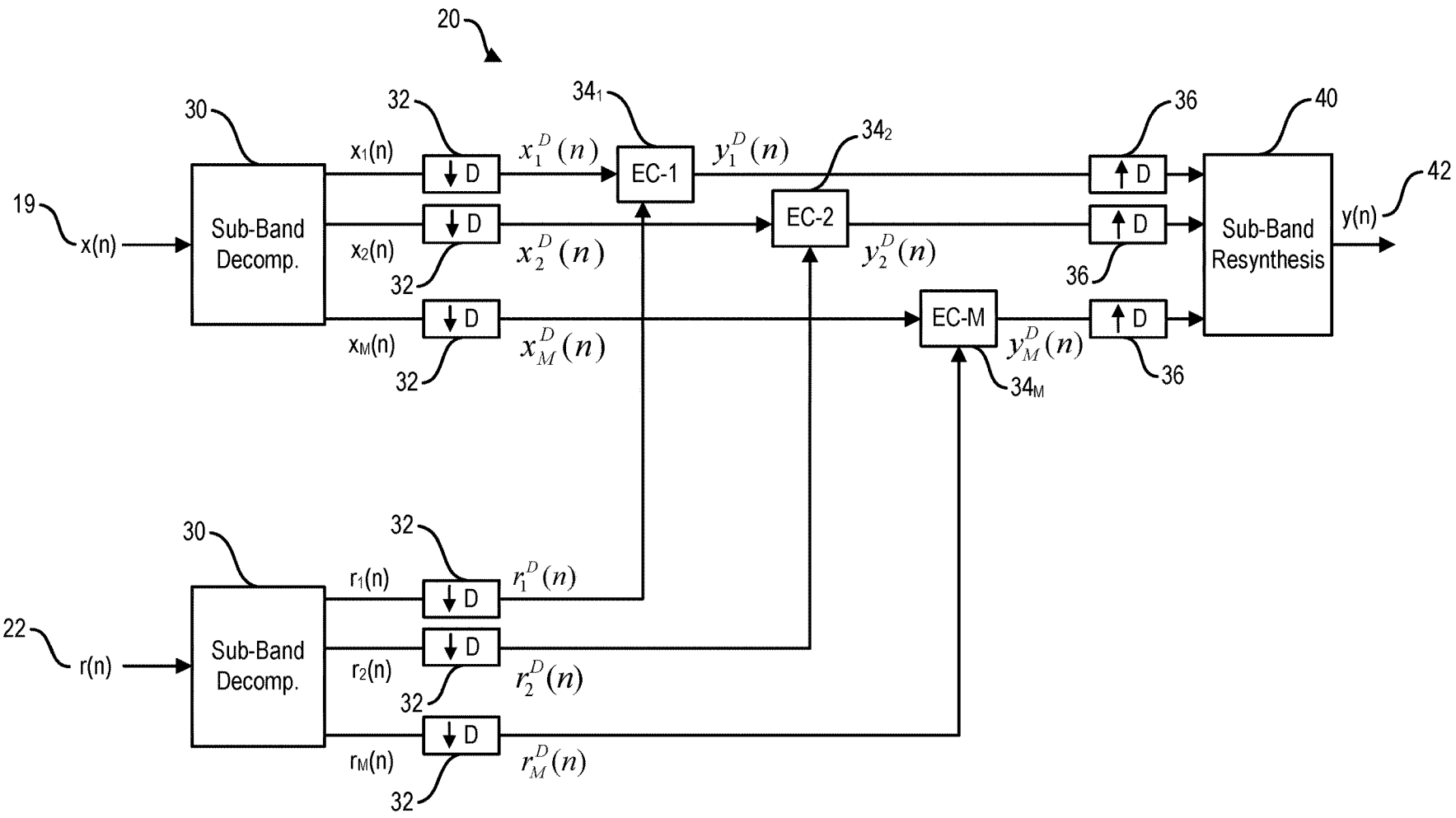
(PRIOR ART) FIG. 2
FIG. 2 is a block diagram of a conventional sub-band echo cancellation system.
Figure 3:
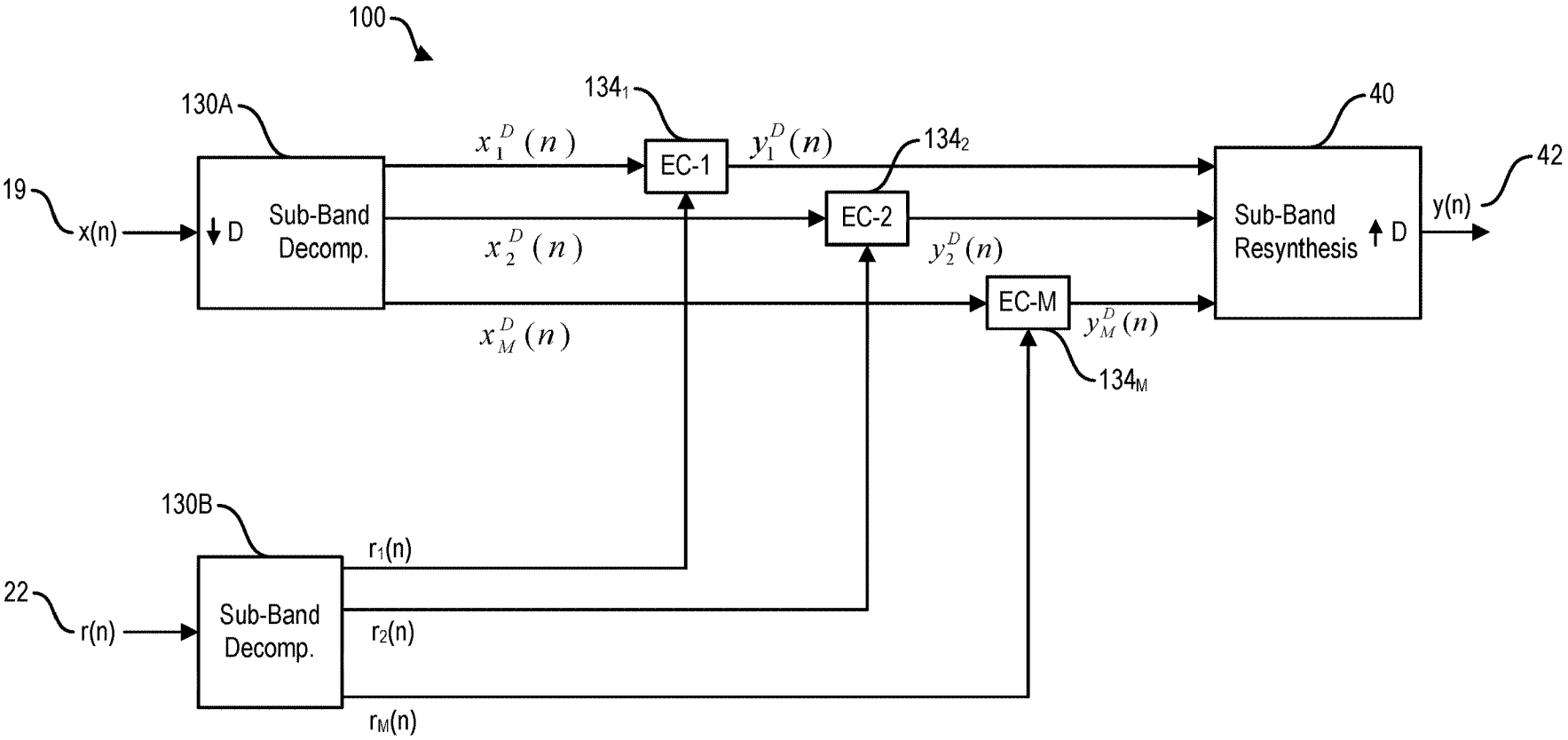
FIG. 3 is a block diagram of a sub-band echo cancellation system according to the present invention.

FIG. 3 illustrates a sub-band based echo-cancellation system 100 according to the present invention (which, e.g., can replace EC system 20, shown in FIGS. 1 and 2). In system 100, the rate of down-sampling of the input signal 19 (x(n)), which occurs within sub-band decomposition module 130A, is D, similar to what is done in conventional EC system 20. However, unlike conventional systems, the rate of down-sampling reference signal 22 (r(n)) is 1 (i.e., no down-sampling). Preferably, the signals that are input into each of the echo cancellation modules $\mathbf{134}_m$, i.e., $x_m^D(n)$ and $r_m(n)$, are at different sampling rates, here R/D and R respectively. At the index n, $x_m^D(n)=x_m(nD)$. The echo reference length L, still at sampling rate R, consists of the time series: $\{r_m(nD), r_m(nD-1), r_m(nD-2), \ldots, r_m(nD-L+1)\}$, and $$y_m^D(n)=x_m^D(n)-\Sigma_{\tau=0}^{L-1}\hat{f}_m(\tau)r_m(nD-\tau) \quad \text{Eq. 2}$$

where $\hat{f}_m$ is the mth sub-band decomposition of $\hat{f}$.

However, for each sub-band m, because it is known that $\hat{f}_m$ and $r_m$ are more band-limited than x, the present inventors have discovered that it is possible to effectively down-sample these two signals by a rate of $D_m$ (typically greater than D, resulting in a lower effective sample rate) and still achieve the same echo estimates as $\Sigma_{\tau=0}^{L-1}\hat{f}_m(\tau)r_m(nD-\tau)$. The choice of the effective down-sampling rate, $D_m$, preferably is only limited by the condition that no (or limited) frequency aliasing happens during such down-sampling process. Therefore, $D_m$ generally can be even larger than D, which is usually chosen to be smaller than the (band-pass) Nyquist down-sampling rate, in order to allow better echo-reduction performance. Considering such effective down-sampling:

$$y_m^D(n)=x_m^D(n)-\Sigma_{\tau=0}^{L/D_m-1}\tilde{f}_m(\tau)r_m(nD-\tau D_m) \quad \text{Eq. 3}$$

where $\tilde{f}_m$ is the $D_m$ rate down-sampled version of $\hat{f}_m$. In the preferred embodiments, a direct estimate is made of $\tilde{f}_m$, rather than $\hat{f}_m$. That is, rather than generating and then down-sampling $\hat{f}_m$, the system finite impulse response function (or other type of system response function in other embodiments) preferably initially is generated at the lower sampling rate ($R/D_m$), i.e., $\tilde{f}_m$. Also, it is noted that in Equation 3, and in system 100, $r_m(n)$ is not actually down-sampled but instead is just effectively down-sampled as a result of the processing performed in the corresponding echo-cancellation module $\mathbf{134}_m$. That is, while $r_m(n)$ remains at a sampling rate of R, the processing (and, more specifically, the convolution processing) is performed within echo-cancellation module $\mathbf{134}_m$ at a processing sample rate of $R/D_m$, i.e., only using every $D_m$ samples of $r_m(n)$. Generally speaking, the full-rate (R sample rate) version of $r_m(n)$ is retained in order to avoid timing mismatches that otherwise would occur as a result of $D_m$ being different than D (e.g., so that the starting point of any particular convolution can be chosen arbitrarily).

In some cases, e.g., as discussed in greater detail below, it will be possible to actually down-sample $r_m(n)$, at least to some extent, without having such mismatches. However, even without any down-sampling of $r_m(n)$, the echo reference length of a given echo cancellation module 134$_m$ is reduced from L or L/D to L/$D_m$, thereby providing the benefits mentioned above.

Also, it should be noted that due to the commutative property of convolution, in alternate embodiments of the invention, $r_m(n)$ actually is down-sampled by $D_m$, or originally obtained at the sampling rate of R/$D_m$, and $\hat{f}_m(n)$ is estimated and retained within the corresponding echo cancellation module 134$_m$ at the full rate R (i.e., $\hat{f}_m(n)$ is just effectively down-sampled, instead of $r_m(n)$). Still further, it is possible to just effectively (rather than actually) down-sample both $r_m(n)$ and $\hat{f}_m(n)$. Any such implementation will result in the same reduction in the echo reference length or, equivalently, in the amount of processing required to be performed by the echo cancellation modules 134$_m$. However, actual down-sampling of at least one of such signals can further reduce processing requirements and, therefore, is preferred. For ease of discussion only, the present disclosure mainly assumes an embodiment in which $\hat{f}_m(n)$ is actually down-sampled by $D_m$ (or initial estimation of $\hat{f}_m$ at a rate that is lower by a factor of $D_m$), while $r_m(n)$ is maintained at the full rate R. However, no loss of generality is intended.

If the $D_m$ s (or, equivalently, the effective sampling rates of $\hat{f}$ and $r_m$) are properly chosen, such that there is a non-trivial common factor (denoted by $D_r$) for $\{D_m, m=1, \ldots, M\}$, as well as for D, such a down-sampling rate $D_r$ can be applied at the sub-band decomposition module 130B for r(n) (similar to what is done in sub-band decomposition module 130A for x(n)), in order to further reduce computational complexity. In such a case, appropriate indexing changes are made to Equation 3 above.

In the preferred embodiments:

(1) The echo reference for $x_m^D(n)$ starts at $r_m(nD)$, meaning the echo reference is $\{r_m(nD), r_m(nD-D_m), r_m(nD-2D_m), \ldots\}$.

(2) $D_m$ is only limited by the condition of no frequency aliasing (potentially with some additional guard band). Therefore, different frequency bands m can use different $D_m$.

(3) Because $D_{m_1}$ can be different from $D_{m_2}$ if $m_1 \neq m_2$, the echo reference lengths of these two sub-bands can also be different. As in conventional sub-band echo cancellation, each sub-band's echo reference length can also be artificially extended or shortened by the designer. Because $D_m$ can be larger than D, with the same echo reference length, the present approach typically can achieve better modeling capability than conventional sub-band echo cancellation without sacrificing stability and convergence speed.

By choosing $\{D_m, m=1, \ldots, M\}$, it is possible to control the computational complexity balance/trade-off between the sub-band echo-cancellation modules and the sub-band decomposition module of r(n). For instance, higher $D_m$ can allow for a shorter echo reference in the corresponding echo cancellation module 134$_m$ but might reduce the possibility of down-sampling at the sub-band decomposition module 130B for r(n).

Figure 4:
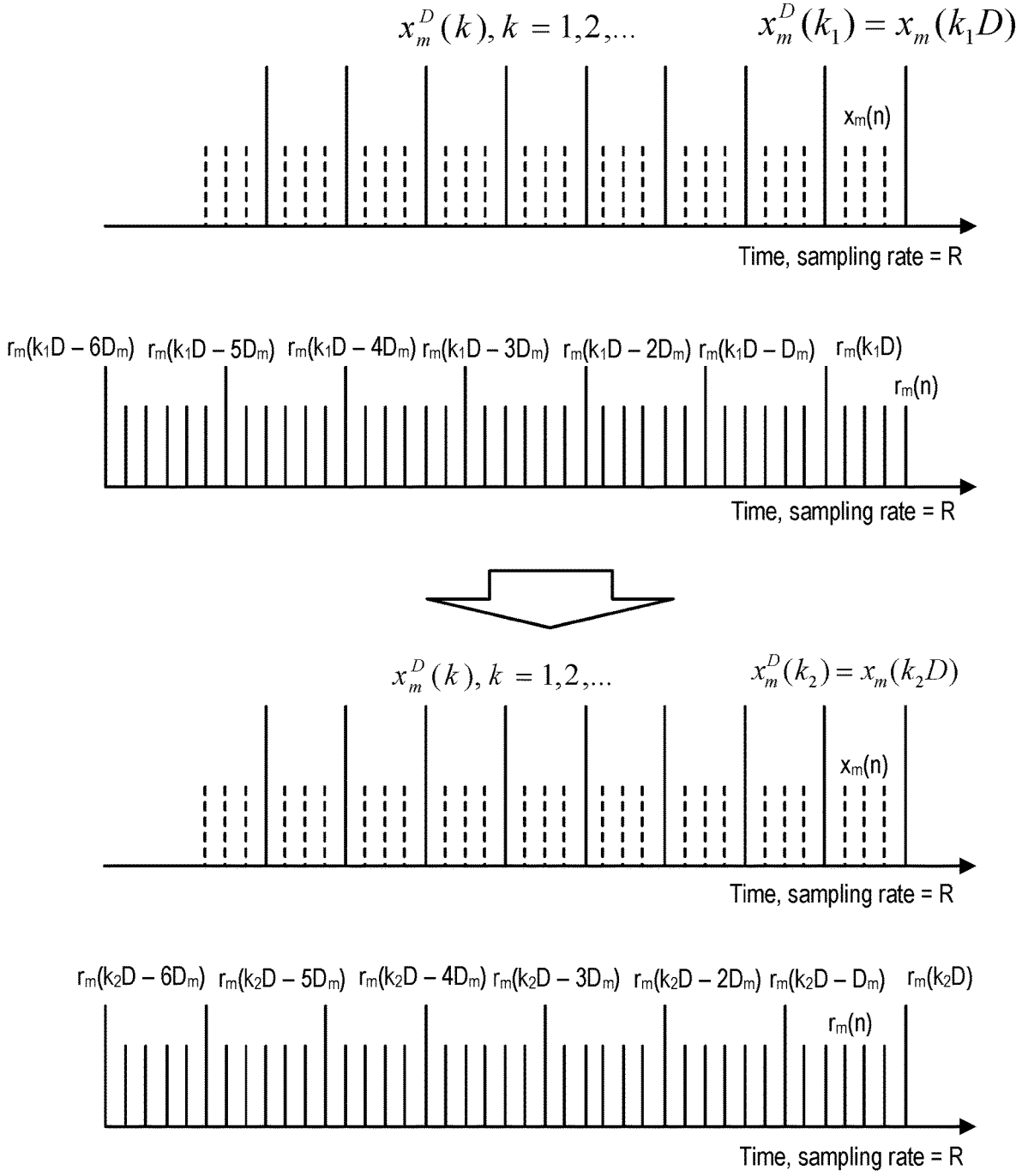
FIG. 4 is a diagram illustrating how the echo reference of a sub-band can be formed.

FIG. 4 illustrates how the echo reference of the mth sub-band can be formed. In this example, D=4, $D_m$=6 and echo reference length L=7$D_m$. At the time index $k_1D$, the sub-band microphone signal is $x_m^D(k_1)=x_m(k_1D)$. Its exemplary (latest) echo reference sample is $r_m(n)$ at the same time index: $r_m(k_1D)$. The following echo reference samples are $\{r_m(k_1D-iD_m), i=0, 1, \ldots, 6\}$. At the next time index $k_2D=(k_1+1)D$, the exemplary corresponding echo reference sample is $r_m(k_2D)=r_m((k_1+1)D)$. The following echo reference samples are $\{r_m(k_1D+D-iD_m), i=0, 1, \ldots, 6\}$.

Figure 5:
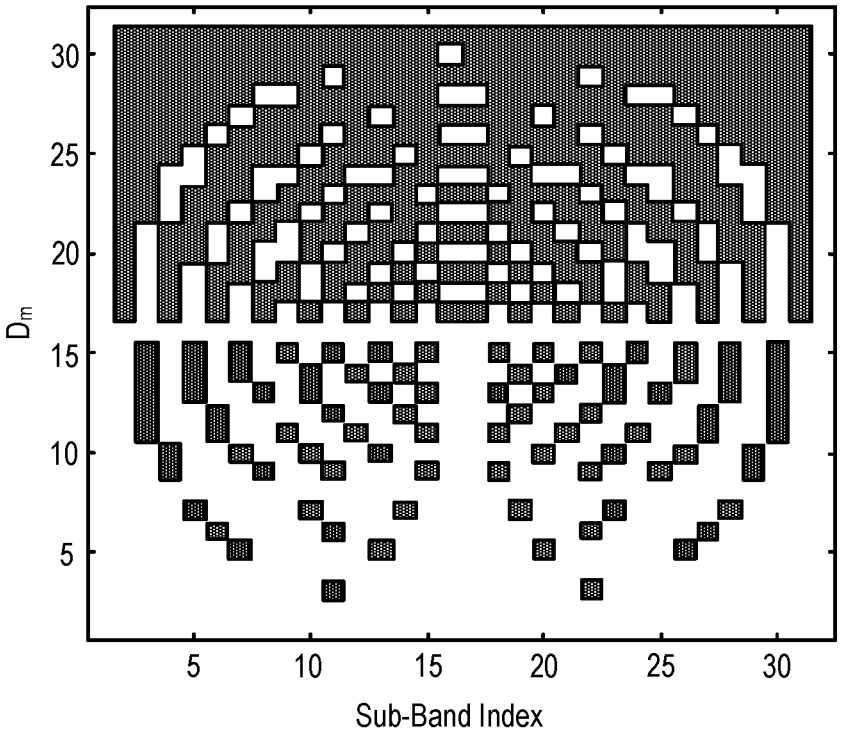
FIG. 5 is a diagram illustrating the preferred acceptable down-sampling rates for different sub-bands with no guard band specified.
Figure 6:
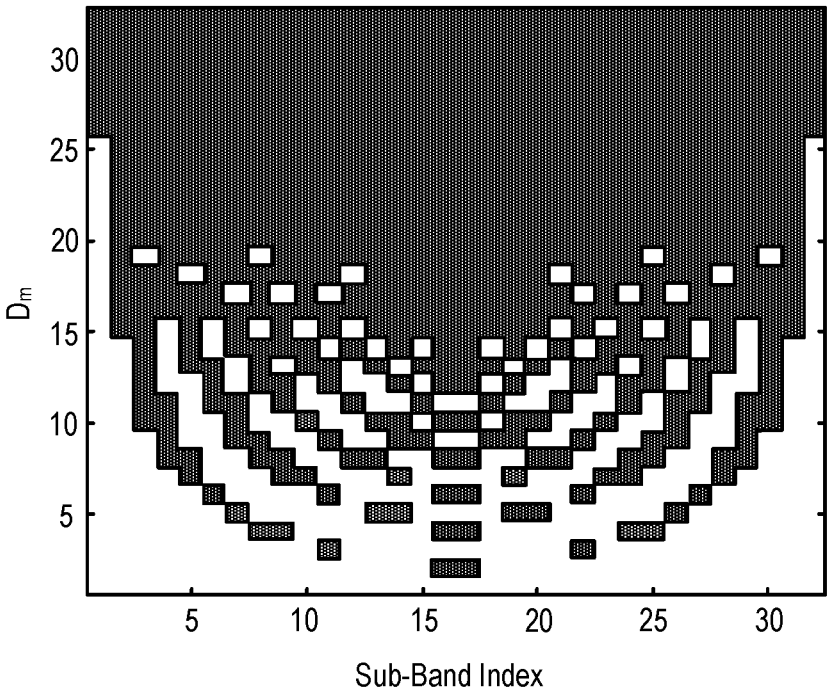
FIG. 6 is a diagram illustrating the preferred acceptable down-sampling rates for different sub-bands with a guard band of 0.5R/4M.
Figure 7:
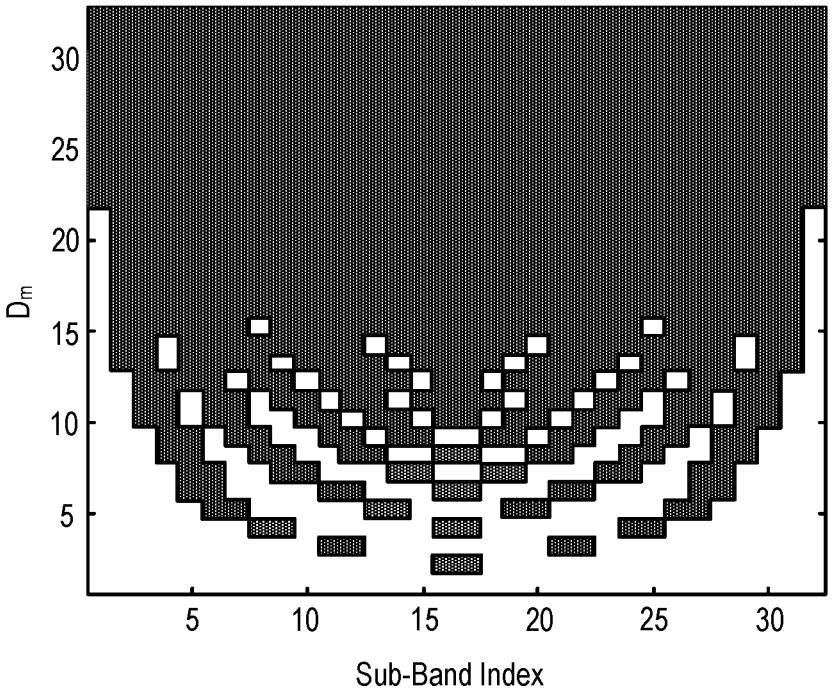
FIG. 7 is a diagram illustrating the preferred acceptable down-sampling rates for different sub-bands with a guard band of R/4M.

With M=32, and without providing any guard-band, the $D_m$s that preferably can be used for each of the different sub-bands are shown as white cells (while the $D_m$s that preferably cannot be used for each of the different sub-bands are shown as black cells) in FIG. 5. However, because of the limited length of the analysis filters of the filter bank 130B, the true bandwidth of each sub-band typically is larger than R/2M. Generally speaking, the larger the desired guard band when choosing $D_m$, the better the performance that will result. With a guard band of 0.5R/4M at each side of each sub-band, FIG. 6 shows (again, as white cells) all the potential $D_m$s that preferably can be used for each of the different sub-bands (while the $D_m$s that preferably cannot be used for each of the different sub-bands again are shown as black cells). It is clear that for most of the sub-bands, $D_m$ can be chosen to be larger than 16 (with M=32, D often is chosen to be 8 or even 4 in sub-band processing systems). Finally, with the guard-band being R/4M at each side of each sub-band, FIG. 7 illustrates (once again, as white cells) all the potential $D_m$s that preferably can be used for each sub-band (while the $D_m$s that preferably cannot be used for each of the different sub-bands again are shown as black cells). Even in this case, there are still choices for each sub-band to have $D_m$ larger than 8.

In a sub-band echo-cancellation system, any frequency aliasing that happens during down-sampling of the echo reference will cause degradation of the echo-reduction performance of the whole EC system. Therefore, in conventional sub-band based EC systems, there generally is no way to avoid frequency aliasing in some or all the sub-bands unless D is chosen to be 1, which would make the system's computational complexity prohibitive when M is non-trivial. In contrast, with a sub-band EC system 100 according to the present invention, it is possible to effectively down-sample the echo reference at each sub-band's EC module 134$_m$, without causing any frequency-aliasing or other performance degradation. Thus, even while avoiding (or limiting) performance degradation, significant savings in computational complexity can be achieved, particularly when M is large.

Further Generalized Embodiments

Figure 8:
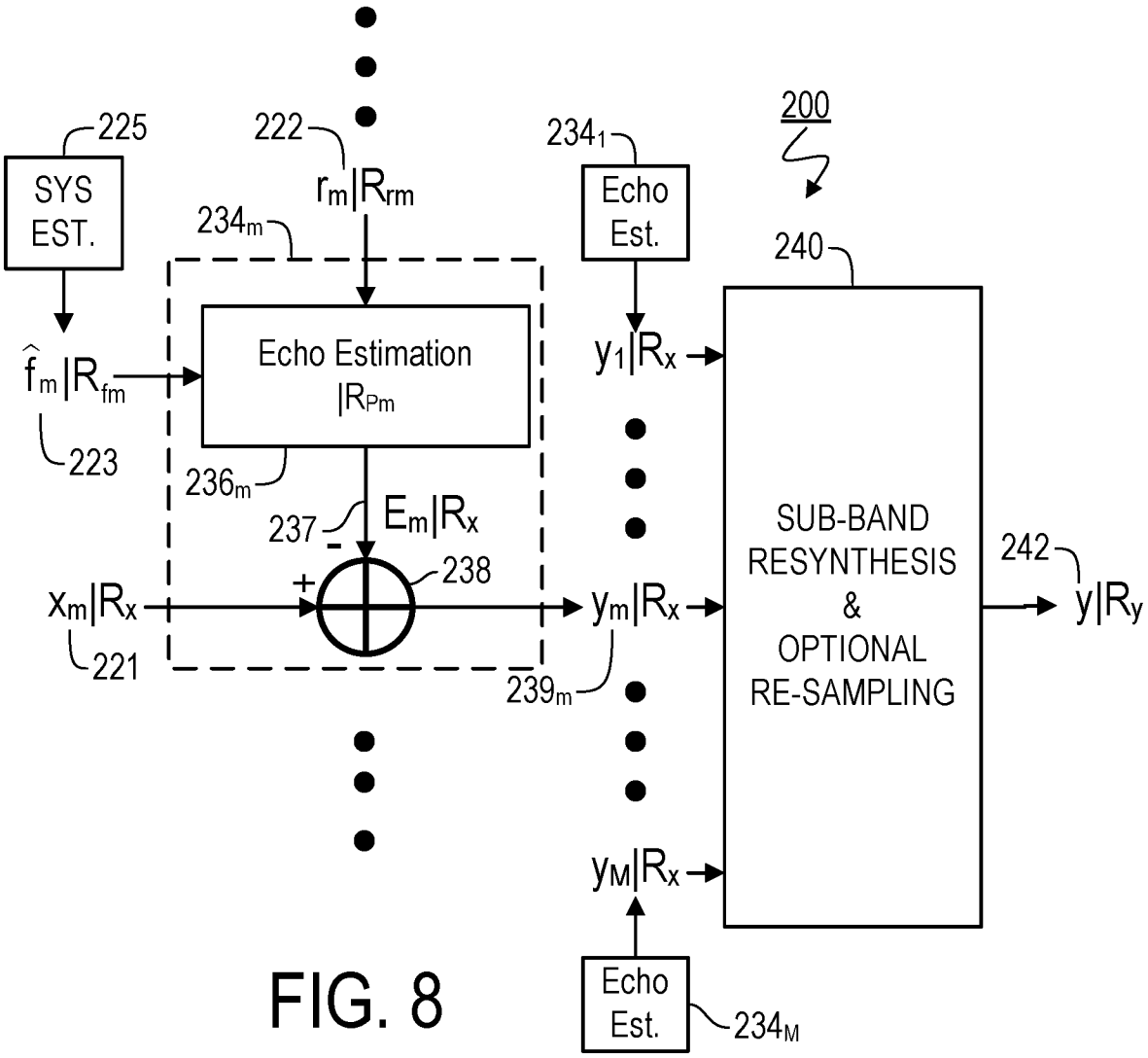
FIG. 8 is a block diagram showing sub-band echo-cancellation processing according to a more generalized embodiment of the present invention.

The preceding discussion mainly is focused on one particular exemplary embodiment, e.g., in order to better and/or more clearly illustrate some of the conceptual underpinnings, of the present invention. A more generalized depiction of an echo-cancellation system 200, according to the preferred embodiments of the present invention, is shown in FIG. 8. As indicated in the discussion below, system 200 can replace EC system 20, shown in FIGS. 1 and 2, given signals 18 and 22 that have been appropriately sampled and separated into frequency bands. Otherwise, additional components (e.g., conventional down-samplers and/or filter banks) may be included to provide such signals.

Similar to system 100, system 200 includes M echo-cancellation processing modules 234$_m$ (although only a single one is shown in detail in FIG. 8), each processing a different equal-width sub-band m and providing an echo-canceled output signal $y_m$ for that sub-band m. Such outputs $y_m$ are then resynthesized 240 (which optionally includes re-sampling, e.g., up-sampling back up to a full-band sampling rate R) to produce the final output signal 242($y$).

In the following discussion, a somewhat different notation is used, as compared to that used above. Each of the signals shown in FIG. 8 is a quantized discrete-time (or digital) version of a continuous-time continuously-variable (or analog) signal. However, because such signals can be (and preferably are) provided at different sampling rates, the indexes (e.g., n) are omitted and, instead, the sampling rate for a signal is indicated next to the signal's label, but separated from it by a I symbol. For example, the notation $r_m|R_{rm}$ refers to the mth sub-band of the reference signal r, having a sampling rate of $R_{rm}$. All of the sampling rates indicated in FIG. 8 and/or mentioned in the present section are time-based rates (e.g., samples per second) which reflect, e.g., the combination of both the signal's original sample rate (as generated, or as sampled from a continuous-time signal) and any subsequent down-sampling or up-sampling that has been applied. That is, e.g., for the purposes of the present more-generalized embodiments, it is irrelevant whether a signal originally had a particular sample rate or subsequently was sub-sampled down to that rate.

In the previous section, it was usually assumed that all signals initially have a full sample rate of R. However, in the present, more-generalized embodiments, no such assumption is made (although the concept of there being an underlying common sample rate of R, with all of the actual sample rates being an integer sub-rate of R is still useful). Instead, for example, the input signal x might initially be sampled (or otherwise input) at a lower rate. Similarly, the full sample rate R might be used only for the output signal, or even not at all, within the audio subsystem of which echo-cancellation system 200 is a part.

As in the previously discussed exemplary embodiment, system 200 also is a sub-band EC system, having a separate echo-cancellation processing module $\mathbf{234}_m$ for each sub-band m. Although only a single such module $\mathbf{234}_m$ is shown in detail in FIG. 8, modules $\mathbf{234}_1$-$\mathbf{234}_M$ are similar, with each producing an output signal $\mathbf{239}_m$ ($y_m$).

Each echo-cancellation processing module $\mathbf{234}_m$ includes an echo estimation module $\mathbf{236}_m$ that inputs the mth sub-band of a reference signal 222 (i.e., $r_m$), having a sample rate of $R_{rm}$. In the exemplary embodiment discussed above, $R_{rm}$ typically will be R, but, e.g., as noted above, $r_m$ previously might have been down-sampled by $D_r$, or might have been initially input at a different sampling rate. Module $\mathbf{236}_m$ also inputs the mth sub-band of an impulse response estimate 223 ($\hat{f}_m$), having a sampling rate of $R_{fm}$. In the exemplary embodiment discussed above, $R_{fm}$ typically will be $R/D_m$ either as a result of downsampling or initially input at such rate, but instead might be at a different sampling rate, such as R. Preferably, at least one of $r_m$ and $\hat{f}_m$ is at a lower sampling rate, as discussed above. In the current embodiments, as in system 100 discussed above, $\hat{f}_m$ is generated by system response estimation module 225 in a conventional manner, e.g., using a Least-Mean-Square (LMS) or Normalized-Least-Mean-Square (NLMS) algorithm, and thereby updated continuously.

In any event, echo estimation module $\mathbf{236}_m$ generates an estimate of the echo (e.g., received at the microphone 16) based on these two input signals ($r_m$ 222 and $\hat{f}_m$ 223). In the preferred embodiments, the main (or even sole) processing performed by each echo estimation module $\mathbf{236}_m$ is a convolution between $r_m$ 222 and $\hat{f}_m$ 223. At least some of such processing (e.g., at least the convolution processing) is performed at a sample rate of $R_{Pm}$. Typically, at least two of the sample rates $R_{rm}$, $R_{fm}$ and $R_{Pm}$ are different from each other, so one of the signals $r_m$ 222 or $\hat{f}_n$ 223 is indexed differently (e.g., less frequently, with more skipped samples) than the other. For example, in the exemplary embodiment described above, $R_{fm}=R_{Pm}<R_{rm}$, so $r_m$ is indexed during such processing with more sample skips.

The mth sub-band output echo estimate 237 ($E_m$) of echo estimation module $\mathbf{236}_m$, preferably is at the same sample rate ($R_x$) as the mth sub-band input signal 221 ($x_m$). Such mth sub-band output echo estimate 237 ($E_m$) is subtracted from the mth sub-band input signal 221 ($x_m$) in subtractor 238 to provide the mth sub-band echo-corrected signal $\mathbf{239}_m$ ($y_m$), also at the sample rate $R_x$. All of such sub-band echo-corrected signals $\mathbf{239}_m$ are then resynthesized into the final output signal 242 (y at a sample rate of $R_y$) in sub-band resynthesis module 240, which can also include any desired re-sampling (e.g., up-sampling, particularly if x had been down-sampled).

As indicated above, one of the advantages of the present invention is that different sampling rates can be used for the various signals and processing throughout the system 200. For instance, for the reasons noted above, it usually is preferable for all or at least a portion of the processing performed in some or all of the echo estimation modules $\mathbf{236}_m$ to be at sample rate(s) $R_{Pm}$ that are different than (preferably lower than) the rate $R_x$ of the input signal 221 ($x_m$), even after taking into account any down-sampling of input signal 221.

Another advantage of the present invention is that the processing sample rates ($R_{Pm}$) of the echo estimation modules $\mathbf{236}_m$ (for the different sub-bands m) can be different from each other. Generally speaking, it is preferable that the sample rates of the individual signals are selected appropriately such that: (1) aliasing is avoided or at least limited to an acceptable level; (2) the echo estimation signal 237 has the same sampling rate as the input signal 221; and (3) sufficient samples are available to perform the echo estimation processing in the corresponding module $\mathbf{236}_m$. As noted in connection with the exemplary embodiment discussed above, this can be achieved by using the full sample rate R for the reference signal 222 or the impulse response estimate 223 and using a subrate $R/N_1$ for the other such signal, together with a second subrate $R/N_2$ for the input signal 221, where $N_1$ and $N_2$ are integers that are greater than or equal to 1. However, other appropriate rate selections are available and will be apparent to those of ordinary skill in the art based on the present teachings.

In the foregoing embodiments, echo is estimated based on a reference signal and an estimated impulse response. However, in alternate embodiments, echo may be estimated based on the reference signal and any other system-characterizing function, such as a frequency-based transfer function or a function that describes the system's response to any input other than an impulse.

System Environment.

Generally speaking, except where clearly indicated otherwise, all of the systems, methods, functionality and techniques described herein can be practiced with the use of one or more programmable general-purpose computing devices. Such devices (e.g., including any of the electronic devices mentioned herein) typically will include, for example, at least some of the following components coupled to each other, e.g., via a common bus: (1) one or more central processing units (CPUs); (2) read-only memory (ROM); (3) random access memory (RAM); (4) other integrated or attached storage devices; (5) input/output software and circuitry for interfacing with other devices (e.g., using a hardwired connection, such as a serial port, a parallel port, a USB connection or a FireWire connection, or using a wireless protocol, such as radio-frequency identification (RFID), any other near-field communication (NFC) protocol, Bluetooth or a 802.11 protocol); (6) software and circuitry for connecting to one or more networks, e.g., using a hardwired connection such as an Ethernet card or a wireless protocol, such as code division multiple access (CDMA), global system for mobile communications (GSM), Bluetooth, a 802.11 protocol, or any other cellular-based or non-cellular-based system, which networks, in turn, in many embodiments of the invention, connect to the Internet or to any other networks; (7) a display (such as a cathode ray tube display, a liquid crystal display, an organic light-emitting display, a polymeric light-emitting display or any other thin-film display); (8) other output devices (such as one or more speakers, a headphone set, a laser or other light projector and/or a printer); (9) one or more input devices (such as a mouse, one or more physical switches or variable controls, a touchpad, tablet, touch-sensitive display or other pointing device, a keyboard, a keypad, a microphone and/or a camera or scanner); (10) a mass storage unit (such as a hard disk drive or a solid-state drive); (11) a real-time clock; (12) a removable storage read/write device (such as a flash drive, any other portable drive that utilizes semiconductor memory, a magnetic disk, a magnetic tape, an opto-magnetic disk, an optical disk, or the like); and/or (13) a modem (e.g., for sending faxes or for connecting to the Internet or to any other computer network). In operation, the process steps to implement the above methods and functionality, to the extent performed by such a general-purpose computer, typically initially are stored in mass storage (e.g., a hard disk or solid-state drive), are downloaded into RAM, and then are executed by the CPU out of RAM. However, in some cases the process steps initially are stored in RAM or ROM and/or are directly executed out of mass storage.

Suitable general-purpose programmable devices for use in implementing the present invention may be obtained from various vendors. In the various embodiments, different types of devices are used depending upon the size and complexity of the tasks. Such devices can include, e.g., mainframe computers, multiprocessor computers, one or more server boxes, workstations, personal (e.g., desktop, laptop, tablet or slate) computers and/or even smaller computers, such as personal digital assistants (PDAs), wireless telephones (e.g., smartphones) or any other programmable appliance or device, whether stand-alone, hard-wired into a network or wirelessly connected to a network.

In addition, although general-purpose programmable devices can be used in the systems described above, in alternate embodiments one or more special-purpose processors or computers instead (or in addition) are used. In general, it should be noted that, except as expressly noted otherwise, any of the functionality described above can be implemented by a general-purpose processor executing software and/or firmware, by dedicated (e.g., logic-based) hardware, or any combination of these approaches, with the particular implementation being selected based on known engineering tradeoffs. More specifically, where any process and/or functionality described above is implemented in a fixed, predetermined and/or logical manner, it can be accomplished by a processor executing programming (e.g., software or firmware), an appropriate arrangement of logic components (hardware), or any combination of the two, as will be readily appreciated by those skilled in the art. In other words, it is well-understood how to convert logical and/or arithmetic operations into instructions for performing such operations within a processor and/or into logic gate configurations for performing such operations; in fact, compilers typically are available for both kinds of conversions.

It should be understood that the present invention also relates to machine-readable tangible (or non-transitory) media on which are stored software or firmware program instructions (i.e., computer-executable process instructions) for performing the methods and functionality of this invention. Such media include, by way of example, magnetic disks, magnetic tape, optically readable media such as CDs and DVDs, or semiconductor memory such as various types of memory cards, USB flash memory devices, solid-state drives, etc. In each case, the medium may take the form of a portable item such as a miniature disk drive or a small disk, diskette, cassette, cartridge, card, stick etc., or it may take the form of a relatively larger or less-mobile item such as a hard disk drive, ROM or RAM provided in a computer or other device. As used herein, unless clearly noted otherwise, references to computer-executable process steps stored on a computer-readable or machine-readable medium are intended to encompass situations in which such process steps are stored on a single medium, as well as situations in which such process steps are stored across multiple media.

The foregoing description primarily emphasizes electronic computers and devices. However, it should be understood that any other computing or other type of device instead may be used, such as a device utilizing any combination of electronic, optical, biological and chemical processing that is capable of performing basic logical and/or arithmetic operations.

In addition, where the present disclosure refers to a processor, computer, server, server device, computer-readable medium or other storage device, client device, or any other kind of apparatus or device, such references should be understood as encompassing the use of plural such processors, computers, servers, server devices, computer-readable media or other storage devices, client devices, or any other such apparatuses or devices, except to the extent clearly indicated otherwise. For instance, a server generally can (and often will) be implemented using a single device or a cluster of server devices (either local or geographically dispersed), e.g., with appropriate load balancing. Similarly, a server device and a client device often will cooperate in executing the process steps of a complete method, e.g., with each such device having its own storage device(s) storing a portion of such process steps and its own processor(s) executing those process steps.

Additional Considerations.

As used herein, the term "coupled", or any other form of the word, is intended to mean either directly connected or connected through one or more other elements or processing blocks, e.g., for the purpose of preprocessing. In the drawings and/or the discussions of them, where individual steps, modules or processing blocks are shown and/or discussed as being directly connected to each other, such connections should be understood as couplings, which may include additional elements and/or processing blocks. Unless otherwise expressly and specifically stated otherwise herein to the contrary, references to a signal herein mean any processed or unprocessed version of the signal. That is, specific processing steps discussed and/or claimed herein are not intended to be exclusive; rather, intermediate processing may be performed between any two processing steps expressly discussed or claimed herein.

As used herein, the term "attached", or any other form of the word, without further modification, is intended to mean directly attached, attached through one or more other intermediate elements or components, or integrally formed together. In the drawings and/or the discussion, where two individual components or elements are shown and/or discussed as being directly attached to each other, such attachments should be understood as being merely exemplary, and in alternate embodiments the attachment instead may include additional components or elements between such two components. Similarly, method steps discussed and/or claimed herein are not intended to be exclusive; rather, intermediate steps may be performed between any two steps expressly discussed or claimed herein.

In the preceding discussion, the terms "operators", "operations", "functions" and similar terms refer to process steps or hardware components, depending upon the particular implementation/embodiment.

Unless clearly indicated to the contrary, words such as "optimal", "optimize", "maximize", "minimize", "best", as well as similar words and other words and suffixes denoting comparison, in the above discussion are not used in their absolute sense. Instead, such terms ordinarily are intended to be understood in light of any other potential constraints, such as user-specified constraints and objectives, as well as cost and processing or manufacturing constraints.

In the above discussion, certain processes and/or methods are explained by breaking them down into functions or steps listed in a particular order. However, it should be noted that in each such case, except to the extent clearly indicated to the contrary or mandated by practical considerations (such as where the results from one function or step are necessary to perform another), the indicated order is not critical but, instead, that the described functions and steps can be reordered and/or two or more of such steps can be performed concurrently.

References herein to a "criterion", "multiple criteria", "condition", "conditions" or similar words which are intended to trigger, limit, filter or otherwise affect processing steps, other actions, the subjects of processing steps or actions, or any other activity or data, are intended to mean "one or more", irrespective of whether the singular or the plural form has been used. For instance, any criterion or condition can include any combination (e.g., Boolean combination) of actions, events and/or occurrences (i.e., a multi-part criterion or condition).

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

In the discussions above, the words "include", "includes", "including", and all other forms of the word should not be understood as limiting, but rather any specific items following such words should be understood as being merely exemplary.

Several different embodiments of the present invention are described above [and in the documents incorporated by reference herein, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the intent and the scope of the invention. Accordingly, the invention is not limited to the precise embodiments shown in the drawings and described above. Rather, it is intended that all such variations not departing from the intent of the invention are to be considered as within the scope thereof as limited solely by the claims appended hereto.

What is claimed is:

1. A method of reducing echo in an audio signal, comprising:

(a) obtaining an input signal, an estimate of a system-characterizing function, and a reference signal, each at a corresponding sample rate and each divided into a plurality of sub-bands;

(b) separately processing said sub-bands, wherein for a given sub-band the estimate of the system-characterizing function and the reference signal are processed at a first sample rate to generate an echo-estimation signal at a second sample rate and then said echo-estimation signal is subtracted from the input signal at said second sample rate to provide an echo-corrected signal at said second sample rate for said given sub-band; and (c) combining the echo-corrected signal from each of different ones of the plurality of the sub-bands to provide a final output signal, wherein said first sample rate is lower than said second sample rate, and wherein when processed to generate the echo-estimation signal, the system-characterizing function and the reference signal have different sample rates.

2. A method according to claim 1, wherein the estimate of the system-characterizing function is an impulse response estimate.

3. A method according to claim 1, wherein the estimate of the system-characterizing function has been generated using at least one of a Least-Mean-Square (LMS) or a Normalized-Least-Mean-Square (NLMS) algorithm.

4. A method according to claim 1, wherein said echo-estimation signal is generated by performing a convolution of the estimate of the system-characterizing function and the reference signal, at said first sample rate.

5. A method according to claim 1, wherein said echo-estimation signal is generated for different ones of the sub-bands using different processing sample rates.

6. A method according to claim 1, wherein (a) a first one of the reference signal or the estimate of the system-characterizing function has a sample rate that is equal to the first sample rate used to generate the echo-estimation signal and (b) a second one of the reference signal or estimate of the system-characterizing function has a higher sample rate.

7. A method according to claim 6, wherein the system-characterizing function has the first sample rate, and the reference signal has the higher sample rate.

8. A method according to claim 6, wherein the second sample rate of the input signal has been achieved by down-sampling the input signal from a full sample rate.

9. A method according to claim 8, wherein said higher sample rate is equal to the full sample rate for the input signal.

10. A method according to claim 1, wherein when processed to generate the echo-estimation signal, a first one of the system-characterizing function and the reference signal is indexed less frequently, with more skipped samples, than a second one of the system-characterizing function and the reference signal.

11. A method according to claim 1, wherein said combining step also comprises up-sampling.

12. A system for reducing echo in an audio signal, comprising:

(a) a plurality of inputs for inputting: an input signal, an estimate of a system-characterizing function, and a reference signal, each at a corresponding sample rate and each divided into a plurality of sub-bands;

(b) a plurality of echo-cancellation modules, each said echo-cancellation module including: (i) an echo-estimation module that inputs the estimate of the system-characterizing function at a first sample rate and the reference signal at a second sample rate and that, processing at a third sample rate, outputs an echo estimate signal at a fourth sample rate, and (ii) a subtractor that subtracts the echo estimate signal from the input signal, also at the fourth sample rate, to produce an echo-canceled sub-band signal at the fourth sample rate; and (c) a synthesis module that synthesizes the echo-canceled sub-band signals from said echo-cancellation modules to produce a final output signal, wherein the third sample rate is lower than the fourth sample rate, and wherein when processed to generate the echo estimate signal within at least one of echo-cancellation modules, the system-characterizing function and the reference signal have different sample rates.

13. A system according to claim 12, wherein the estimate of the system-characterizing function is an impulse response estimate.

14. A system according to claim 12, further comprising a module that generates the estimate of the system-characterizing function using at least one of a Least-Mean-Square (LMS) or a Normalized-Least-Mean-Square (NLMS) algorithm.

15. A system according to claim 12, wherein said echo-estimation module performs, at the third sample rate, a convolution of the estimate of the system-characterizing function and the reference signal.

16. A system according to claim 12, wherein said echo-estimation modules employ different processing sample rates across said plurality of echo-cancellation modules.

17. A system according to claim 12, wherein (a) a first one of the first sample rate or the second sample rate is equal to the third sample rate and (b) a second one of the first sample rate or the second sample rate is higher than the third sample rate.

18. A system according to claim 17 wherein the fourth sample rate of the input signal has been achieved by down-sampling the input signal from a full sample rate.

19. A system according to claim 18, wherein said higher sample rate is equal to the full sample rate for the input signal.

20. A system according to claim 12, wherein said synthesis module also performs up-sampling.

* * * * *